United States Patent [19]

Anderson

[11] 3,982,698

[45] Sept. 28, 1976

[54] NOZZLE SELECTOR VALVE

[75] Inventor: Arthur A. Anderson, St. Paul, Minn.

[73] Assignee: Specialty Manufacturing Company, St. Paul, Minn.

[22] Filed: Jan. 29, 1976

[21] Appl. No.: 653,448

[52] U.S. Cl. ..... 239/394; 239/436

[51] Int. Cl.[2] ..... B05B 1/12; B05B 1/16

[58] Field of Search ..... 239/391, 392, 394, 393, 239/395, 436, 390; 251/207

[56] References Cited

UNITED STATES PATENTS

| | | | |
|---|---|---|---|
| 1,968,391 | 7/1934 | Hamilton | 239/394 |
| 3,112,885 | 12/1963 | Bell et al | 239/436 X |
| 3,377,028 | 4/1968 | Bruggeman | 239/394 |
| 3,516,611 | 6/1970 | Piggott | 239/391 |

FOREIGN PATENTS OR APPLICATIONS

| | | | |
|---|---|---|---|
| 154,677 | 1/1954 | Australia | 239/394 |
| 420,656 | 10/1925 | Germany | 239/391 |
| 475,751 | 11/1937 | United Kingdom | 239/391 |
| 627,906 | 8/1949 | United Kingdom | 239/394 |

*Primary Examiner*—Robert S. Ward, Jr.
*Attorney, Agent, or Firm*—Jacobson and Johnson

[57] ABSTRACT

A multi nozzle high pressure fluid sprayer which can be safely indexed to a selected nozzle while the sprayer is under high fluid pressure. The sprayer contains separate seals at the inlet of each nozzle to permit a safe and effective indexing to either of the nozzles while the fluid is under high pressure or to provide a total shutoff of the fluid. The sealing arrangement includes a channel to provide back pressure to the seal area around each of the nozzles to prevent the seals from being disgorged or damaged as the sprayer head is indexed from nozzle to nozzle while under high pressure.

7 Claims, 10 Drawing Figures

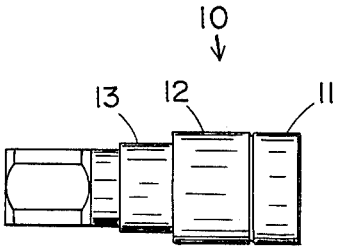
FIG. 1
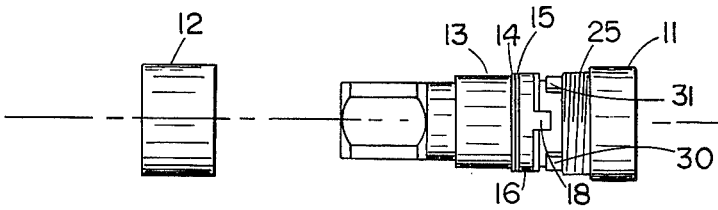
FIG. 2
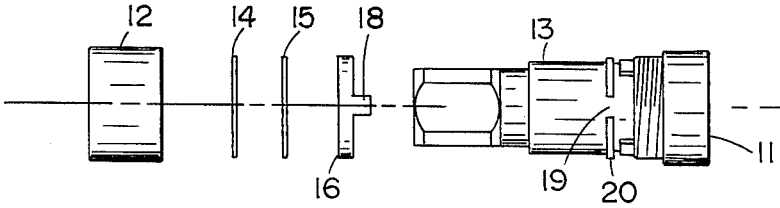
FIG. 3
FIG. 4
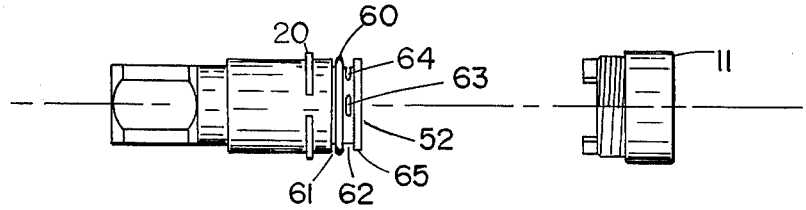
FIG. 5
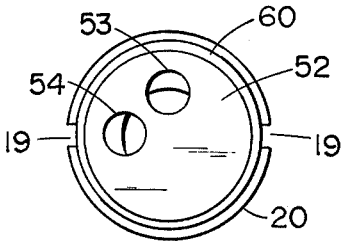
FIG. 7
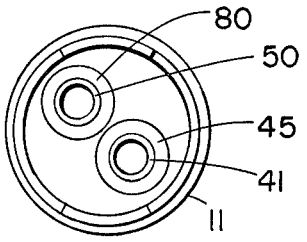
FIG. 8
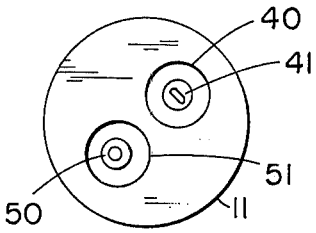
FIG. 6
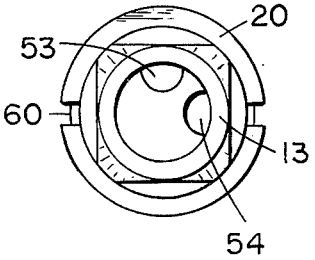
FIG. 9
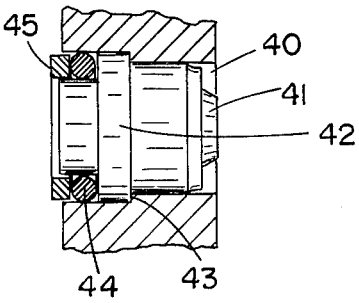

NOZZLE SELECTOR VALVE

BACKGROUND OF THE INVENTION

1. Field of the Invention

This invention relates generally to high pressure sprayers and, more specifically, to high pressure sprayers having multiple nozzles and an indexing assembly which allows the operator to select the appropriate nozzle without shutting off the high pressure fluid to the sprayer.

2. Description of the Prior Art.

The concept of sprayers with plural indexable nozzles are well known as indicated by the Piggott U.S. Pat. No. 3,516,611 and the Bruggeman U.S. Pat. No. 3,377,028. However, these prior art sprayers have serious shortcomings which makes them difficult to use, and in some cases, hazardous to use. One of the problems with prior art high pressure indexable sprayers is that for the operator to index, i.e., select a particular nozzle, the high pressure fluid must be shut off before indexing. If the high pressure fluid is not shut off, the seals within the sprayer will be ruined during the indexing.

The cause of the indexing problem with high pressure fluid is that the high pressure fluid acting on one side of the seal, partially displaces the seal from its required total confinement for indexing. Consequently, indexing results in a pinching, cutting or total destruction of the seal as the nozzle is indexed, i.e., rotated within the sprayer head. To avoid this problem, most commercial high pressure sprayers carry warnings such as "index with pressure off". Even so, indexing under pressure, whether intentional or accidental, is the most common cause of seal failure in indexing sprayers. Not only is seal destruction a problem but the destructive force of a high pressure fluid stream which may be under pressures as high as 1000 psi., can be hazardous to an operator should the operator accidently come in contact with the high pressure stream of fluid. Consequently, some indexing sprayers have provided bleed ports so that in the event of seal failure, high pressure fluid is directed away from the operator.

The present invention provides a solution to the above problem by providing an indexable sprayer which can be safely indexed even though under high fluid pressures, without fear of the sprayer seals being damaged by indexing while under high fluid pressure. The present sprayer is also small and compact making it convenient to use.

BRIEF SUMMARY OF THE INVENTION

In the present invention, two nozzles each having a seal therearound, are located on the end face of a cup-shaped circular head which is rotatably mounted and held on the body of the sprayer by a threaded cap. A fluid passage for supplying high pressure fluid is located in line with the set of nozzles. A further seal comprising a O ring and a pair of thrust washers is located around the body of the sprayer and between a ridge on the body of the sprayer and the back of the threaded cap. The thrust washers allow rotation of the head and threaded cap with respect to the sprayer body while the O ring seals the high pressure fluid within the sprayer. The set of resilient seals which are located concentrically around the inlet of each of the nozzles have high pressure fluid on both sides of the seals so that the seals are not under fluid pressure which would force the seal out of its groove.

One of the novel features of the present invention is a multiple indexing nozzle for use in high pressure systems in which the pressures are equalized on both sides of the seals of the nozzles so that anyone of a plurality of nozzles can be selected without damaging or destroying the seals within the nozzle.

BRIEF DESCRIPTION OF THE DRAWING

FIG. 1 is a side view of an assembled nozzle;

FIG. 2 is a partially disassembled nozzle;

FIG. 3 is a further disassembled nozzle;

FIG. 4 shows the main body of the nozzle and the head;

FIG. 5 is an end view of the body showing FIG. 4;

FIG. 6 is an opposite end view of the body shown in FIG. 4;

FIG. 7 is an interior end view of the cap;

FIG. 8 is an exterior end view of the cap;

FIG. 9 is a cross sectional view of one of the nozzles, and

PREFERRED DESCRIPTION OF THE EMBODIMENT

Figure 10:
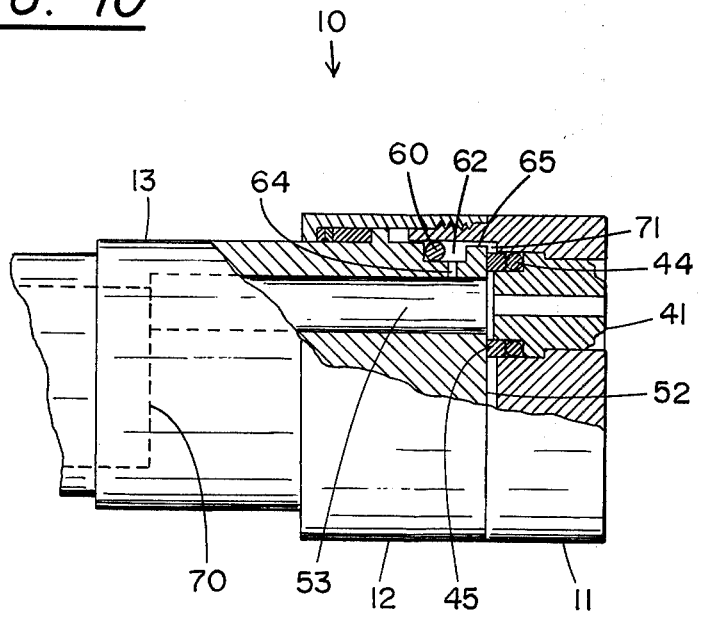
FIG. 10 is a sectional view of the sprayer showing the path of the high pressure fluid.

Referring to FIG. 1, reference numeral 10 shows my assembled, indexable sprayer which comprises a main body 13, a threaded cap 12 and an indexable head 11. Reference to FIGS. 1 through 4 will reveal the other portions of the sprayer in more detail.

A pair of thrust washers 14 and 15 and a stop 16 are located around body 13. Stop 16 can be seen in FIG. 2 and has a pair of ears 18 which project through a corresponding pair of openings 19 in a ridge 20 which is located around body 13. A reference to the end view of FIG. 5 shows the pair of openings 19 in ridge 20 are located on opposite sides of body 13.

Located in line with body 13 is head 11 which has a male threaded portion 25 thereon for engaging with a female threaded portion located inside of cap 12. When cap 12 is threaded onto head 11, the unit appears as shown in FIG. 1 with the thrust washers and stop held in the position shown in FIG. 2 by cap 12.

Head 11 contains a pair of ears 30 and 31. In the assembled condition, ear 30 will engage ear 18 as head 11 is rotated in one direction and ear 31 will engage ear 18 as head 11 is rotated in the opposite direction. The purpose of providing head 11 with ears 30 and 31 is so that the nozzles which are located in the head can be positively aligned with the fluid chamber in body 13 through openings in face 52; that is, when ear 31 engages ear 18, a first nozzle will be connected to the high pressure fluid source through opening 53 (FIG. 5) and when ear 30 engages ear 18, the second nozzle will be connected to the high pressure fluid source through opening 54 (FIG. 5).

Referring to FIG. 9, the detail of a nozzle and portion of head 11 are shown partially in cross section and comprise a nozzle opening 40 located in head 11 and a nozzle insert 41 located in opening 40. Nozzle insert 41 has a central fan shaped opening for directing the high pressure fluid therethrough. Nozzle insert 41 contains a flange 42 for engaging with a shoulder 43 located in opening 40 in head 11. Located on the opposite side of flange 42 is an O ring 44 and a seal 45. Typically, O ring 44 is made from a soft, pliable material and seal 45 is of rigid fiberglass or plastic material such as polytetrafluroethylene or the like. O ring 44 prevents any high pressure fluid from leaking around the outside of nozzle insert 41. Note O ring 44 seals between the outside of nozzle insert 41 and the opening 40.

Referring to FIG. 8, the end view of head 11 shows nozzle insert 41 with fan shaped opening located in opening 40 in head 11 and a second nozzle insert 50 having a circular opening located therein. Nozzle insert 50 is located in an opening 51 in head 11.

In order to understand the sealing arrangement that provides equalized pressure on both sides of the seal around the nozzle insert, reference should be made to FIG. 4 and FIG. 5 which show details of the channels and openings in body 13. FIG. 5 shows an end view of body 13 having a first opening 53 and a second opening 54. Openings 53 and 54 are in fluid communication with the high pressure fluid that enters the sprayer through the back section of body 13.

Viewing FIG. 7, one sees the inside of cap 11 and the seal 45, nozzle insert 41, seal 80 and nozzle insert 50. In operation of the sprayer, either nozzle insert 50 will be in alignment with opening 53 or nozzle insert 41 will be in alignment with opening 54. As head 11 is rotated with respect to body 11, one nozzle will be rotated out of alignment with one opening while the other nozzle will be rotated into alignment with the other opening or vice versa.

Viewing the partially disassembled sprayer in FIG. 4 and FIG. 5, one notes an O ring 60 which is located around body 13. O ring 60 seals the high pressure fluid within body 13 by forming a pressure seal against a shoulder 61 located on body 13 and the inside of threaded cap 12. Located in front of O ring 60 is a pair of openings 63 and 64 which communicate with a fluid chamber located behind openings 53 and 54 (FIG. 5). In operation, high pressure fluid is present at the openings 53 and 54 and also at the openings 63 and 64. The high pressure fluid from openings 63 and 64 force O ring 60 against shoulder 61 to prevent leakage of high pressure fluid between body 13 and cap 12.

In order to understand the sealing arrangement around the nozzle inserts, reference should be made to enlarged FIG. 10 which shows a portion of the sprayer 10 which has been cut away to reveal the inner workings and inner fluid passages located within sprayer 10. Reference to FIG. 10 reveals an inner fluid chamber 70, side passage 62 and a chamber 71 which is located between face 52 and head 11. Fluid, under high pressure, passes through passage 62, around lip 65 and into chamber 71 located outside of the sealing ring 45 which is located outside of the nozzle insert 41. The fluid, under high pressure, typically 500 – 1000 psi., in chamber 70 exerts a radial outward force on seal 45 while the fluid in chamber 71 is exerting a radial inward force on seal 45. Thus, seal 45 is not under any differential force. Consequently, seal 45 can be moved past opening 53 by rotation of head 11 without seal 45 being pinched or cut. In order to prevent leakage around the nozzle insert 41, the nozzle insert is sealed to the outside by an O ring 44 which prevents any flow of fluid between the nozzle insert 41 and the opening 40. Similarly, a seal and O rings are located around the second nozzle insert 50.

While the present invention is shown with two nozzles, it is apparent that more nozzle inserts could be used or that a single nozzle insert could be used. In the latter case, rotation of the head would shut off the flow. Also with only one opening in the body and two nozzle inserts, rotation of the nozzle head would provide two positions of operation and two corresponding shut off positions.

I claim:

1. A high pressure sprayer operable for indexing to a particular nozzle while a source of high pressure fluid is in fluid communication with the sprayer comprising:

a body for connecting to a high pressure source, said body having a chamber therein for receiving the high pressure fluid and a face for engaging a sliding seal;

a head rotatably mounted to said body, said body and said head coacting to define a second chamber;

a sealing member located between said body and said head to prevent leakage of high pressure fluid therebetween;

a nozzle insert located in said head, said nozzle insert operable for directing high pressure fluid therethrough;

sealing means located around said nozzle insert for preventing leakage of high pressure fluid between said nozzle insert and said head;

a passageway located in said body and connecting said first chamber to said second chamber so that high pressure fluid is located on the outside of said seal means and the inside of said sealing means to thereby enable an operator to rotate said nozzle insert with respect to said body without damaging said seal.

2. The invention of claim 1 wherein said sealing means comprises a pair of seals.

3. The invention of claim 2 wherein said high pressure sprayer contains a pair of nozzle inserts.

4. The invention of claim 3 wherein said body and said head contain stop means for permitting a predetermined amount of rotation of said head with respect to said body.

5. The invention of claim 4 wherein said pair of seals comprises a first flexible seal and a second more rigid seal.

6. The invention of claim 5 wherein said body contains a groove for receiving a seal for sealing between said body and said head.

7. The invention of claim 6 wherein said sprayer includes a pair of thrust washers to enable the operator to easily rotate said head with respect to said body when said sprayer is under high pressure.

* * * * *

UNITED STATES PATENT OFFICE

CERTIFICATE OF CORRECTION

Patent No. 3,982,698 Dated September 28, 1976

Inventor(~~s~~) Arthur A. Anderson

It is certified that error appears in the above-identified patent and that said Letters Patent are hereby corrected as shown below:

In Col. 4, line 37, "seal" should be --sealing--

Signed and Sealed this

Fourteenth Day of December 1976

[SEAL]

*Attest:*

RUTH C. MASON
*Attesting Officer*

C. MARSHALL DANN
*Commissioner of Patents and Trademarks*